United States Patent [19]

Dunn

[11] Patent Number: 4,864,940

[45] Date of Patent: Sep. 12, 1989

[54] COLLAPSIBLE PALLET

[75] Inventor: George D. Dunn, Fort Smith, Ark.

[73] Assignee: Tate Containers, Inc., Conway, Ark.

[21] Appl. No.: 203,805

[22] Filed: Jun. 8, 1988

[51] Int. Cl.[4] ..... B65D 19/34

[52] U.S. Cl. ..... 108/51.3

[58] Field of Search ..... 108/51.3, 51.1, 56.1; 248/174; 206/600

[56] References Cited

U.S. PATENT DOCUMENTS

| | | | |
|---|---|---|---|
| 2,728,545 | 12/1952 | Hermitage . | |
| 2,997,266 | 8/1961 | Munroe . | |
| 3,000,603 | 9/1959 | Hemann . | |
| 3,115,105 | 1/1962 | Allen . | |
| 3,167,038 | 4/1962 | Brown . | |
| 3,434,435 | 3/1969 | Achermann et al. | 108/51.3 |
| 3,464,371 | 12/1967 | Gifford . | |
| 3,911,834 | 10/1975 | Quaintance . | |
| 3,952,672 | 4/1976 | Gordon et al. . | |
| 4,102,525 | 7/1978 | Albano | 108/51.3 X |
| 4,563,377 | 1/1986 | Melli | 108/51.3 X |

FOREIGN PATENT DOCUMENTS

| | | | |
|---|---|---|---|
| 26164 | 8/1953 | Finland | 108/51.3 |
| 1134601 | 11/1968 | United Kingdom | 108/51.3 |

*Primary Examiner*—Peter A. Aschenbrenner

*Attorney, Agent, or Firm*—Oliff & Berridge

[57] ABSTRACT

A pallet includes a symmetrical structure of two pallet sections, which enable the pallet to assume an erected or collapsed position without disassembly. When the pallet sections are attached to form a symmetrical pallet structure, the pallet structure is collapsible into a V-shaped configuration.

36 Claims, 7 Drawing Sheets

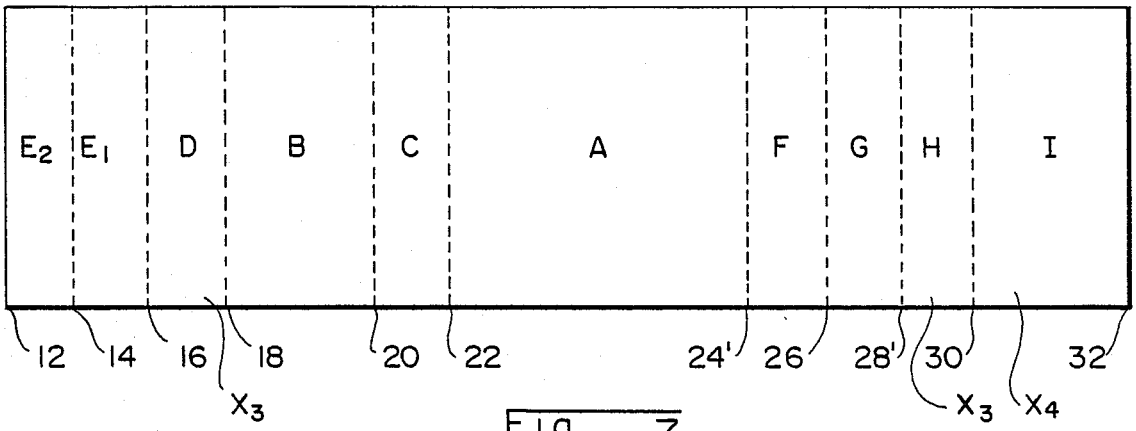
Fig- 7
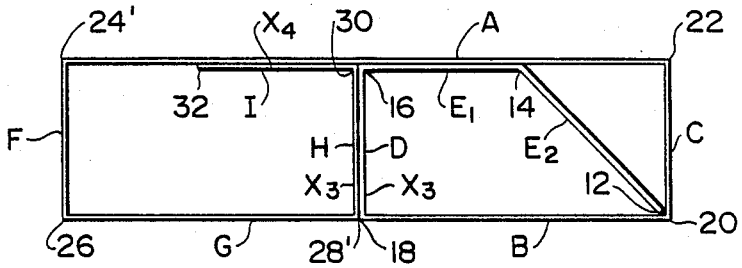
Fig- 8
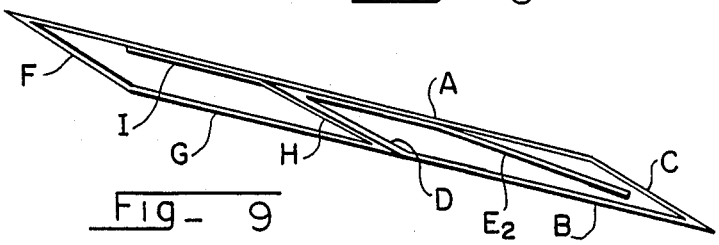
Fig- 9
Fig- 10
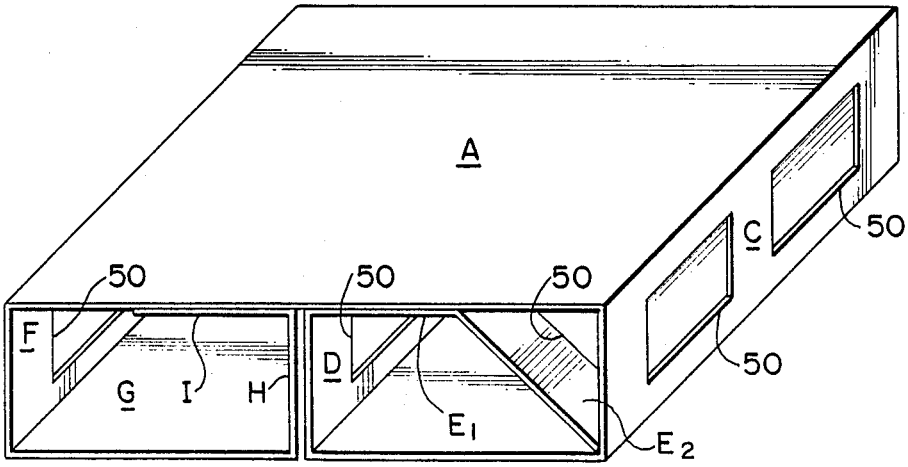

Fig-13A
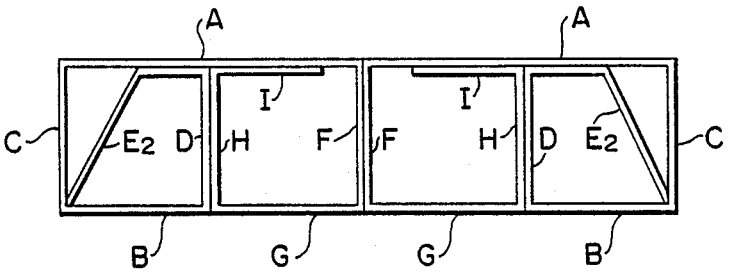
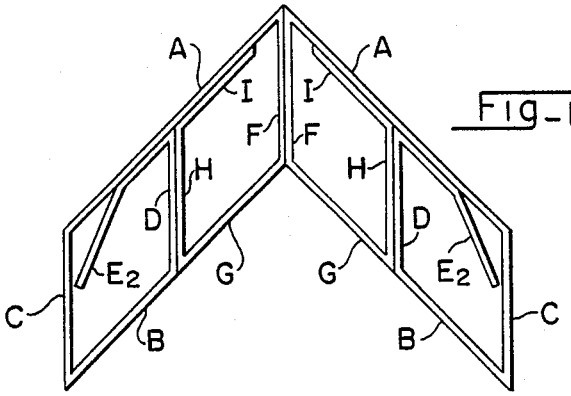
Fig-13B
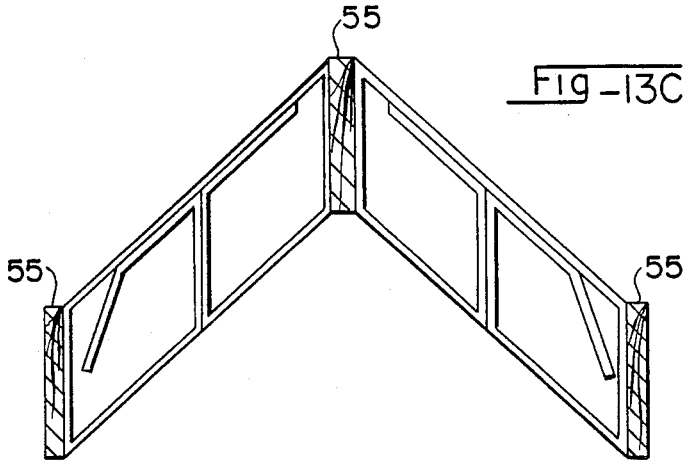
Fig-13C

COLLAPSIBLE PALLET

BACKGROUND AND SUMMARY OF THE INVENTION

The invention relates to a pallet, skid or spacer. More particularly, the invention relates to a pallet, skid or spacer constructed of bendable material which enables the pallet to assume an erected or collapsed position without disassembly.

Conventional pallets or spacers are used for supporting articles during storage or handling. The pallets must be constructed of a strong material to support the articles, yet be inexpensive and disposable. While wooden pallets have been used in the past, wooden pallets are relatively expensive, heavy and require a great deal of storage space when not in use.

Cardboard pallets and spacers are well known as a substitute for wood; see e.g., U.S. Pat. Nos. 2,728,545, 3,000,603, 3,115,105, 3,167,038, 3,952,672, and 4,563,377. These devices, however, are difficult to make with sufficient strength, and are either not collapsible or require disassembly before collapsing.

It is therefore an object of the present invention to provide a sturdy, light-weight pallet which is relatively inexpensive and easy to construct.

It is another object of the present invention to provide a pallet which is collapsible without disassembly of the pallet.

It is a further object of the invention to provide a pallet in which a plurality of pallet sections can be attached to form several configurations of pallets, each pallet being collapsible.

To achieve these and other objects and advantages, the present invention relates to a pallet which includes a symmetrical structure of two or more pallet sections, which enables the pallet section to assume an erected or collapsed position without disassembly. When the pallet sections are attached to form a symmetrical pallet structure, the pallet structure is collapsible into a V-shaped configuration.

BRIEF DESCRIPTION OF THE DRAWINGS

These and other objects and advantages of the present invention will be appreciated from the following detailed description of the preferred embodiments, in which like elements bear like reference numerals, and wherein:

FIG. 7 illustrates a flat sheet of bendable material arranged to form a pallet section in accordance with a fourth embodiment of the present invention;

FIG. 8 is a side view of the pallet section constructed from the sheet of FIG. 7;

FIG. 9 illustrates a side view of the pallet section of FIG. 8 in the collapsed condition;

FIG. 10 illustrates a perspective view of the pallet section of FIG. 8 having a series of aligned openings therein;

FIGS. 13A and 13B illustrate the erected and collapsed conditions of a two-part pallet structure formed by combining two pallet sections of FIG. 8;

FIG. 13C illustrates the pallet structure of FIG. 13B with stiffeners;

DETAILED DESCRIPTION OF THE PREFERRED EMBODIMENTS

Figure 1A:
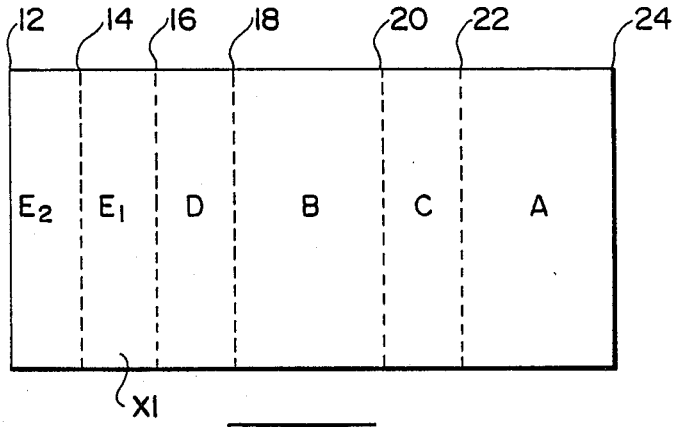
FIGS. 1*a* and 1*b* each illustrate a flat sheet of bendable material arranged to form a pallet section in accordance with the first and second embodiments of the present invention.

FIG. 1*a* illustrates a length or single sheet 10 of cardboard or other bendable sheet-like material. The sheet 10 includes two opposite ends 12, 24, the end 12 being designated hereinafter as the first end. A plurality of fold lines 14, 16, 18, 20 and 22 are provided in the sheet parallel to the ends of the sheet, the pallet being constructed by folding the single sheet along the fold lines as discussed below. Preferably, the sheet is scored along the fold lines to facilitate folding, but such scoring is not necessary. A plurality of supports A–E are defined between adjacent pairs of fold lines 14–22 or a fold line and one of the ends 12, 24.

Figure 2A:
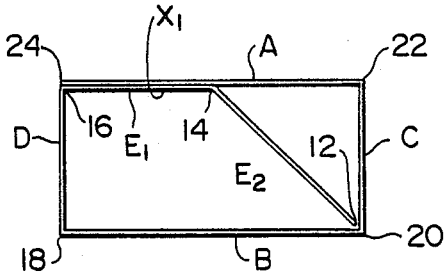
FIGS. 2*a* and 2*b* each illustrate a side view of the pallet section constructed from the sheets of FIGS. 1*a* and 1*b*, respectively.

The pallet section of FIG. 2*a* is formed by folding the sheet of FIG. 1*a* into a channel-like structure with a rectangular cross-section. First and second supports A, B are formed by folding the sheet along the fold lines 22, 20 such that the first and second supports A, B are substantially parallel while a third support C (continguous with the first and second supports A, B) is perpendicular to the first and second support A, B. A fourth support D (continguous with the second support B) is formed parallel to the third support C by bending the fold line 18 so that the fourth support D is perpendicular to the first and second supports A, B. From this folding operation, a channel-like structure having a rectangular cross-section is formed with a fifth support E located inside the channel between the third and fourth supports C, D. The fifth support E has two portions, E1, E2. The first portion E1 between the fold lines 14, 16 is contiguous with the fourth support D. A second portion E2 is located between the fold line 14 and the first end 12, and has a length sufficient to extend from the fold line 14 to the fold line 20 in the erected configuration. In the erected configuration, the first portion E1 is substantially parallel to the first support A and includes an attachment portion X1 which is fixed to the first support A preferably by an adhesive, although other securing mechanisms such as staples are suitable. The second portion E2 extends obliquely with respect to the first and second supports A, B toward the fold line 20 between the second and third supports B, C.

The second portion E2 is unattached to any support. In the erected configuration, the second portion E2 provides stability to the pallet section since it functions as a cross-support for the channel-like structure by extending diagonally between the third and fourth supports C, D toward the corner formed by the fold line 20 between the second and third supports B, C. However, since the second portion E2 is unattached and the fold lines are flexible, the pallet section is collapsible to a substantially flat configuration illustrated in FIG. 3*a*. In the collapsed condition, the angles defined along the fold lines 16, 20 between the fourth and fifth supports D, E and between the second and third supports B, C, respectively, collapse to extend the angles defined along the fold lines 22, 18 between the first and third supports A, C and between the second and fourth supports B, D, respectively. The collapsing movement moves the second portion E2 with the end 12 to a position between the fold lines 20, 22 along the third support C. The erecting movement moves the second portion E2 with the first end 12 toward the fold line 20 where it stabilizes the pallet section.

Figure 1B:
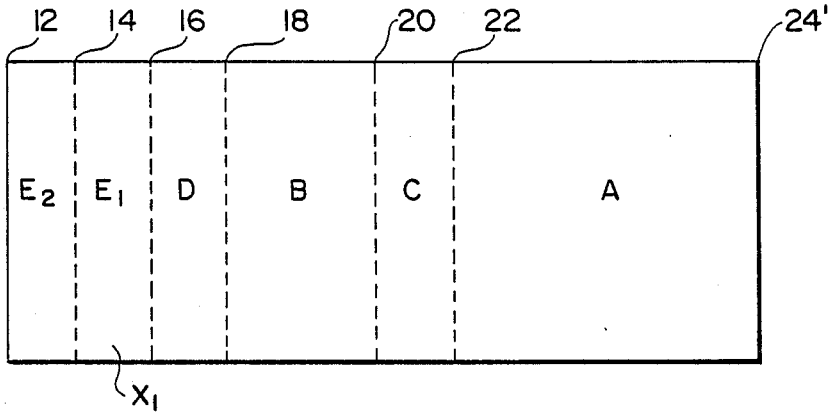

In the embodiment of FIG. 2*a*, the end of the sheet opposite from the first edge 12 is the edge of the first support A. The opposite or second end of the sheet is designated with reference numeral 24 and is located adjacent the fifth support E in the erected condition. However, the length of the first support A may be increased as in FIG. 1*b* to form a second embodiment of the pallet section illustrated in FIG. 2*b*. The pallet section of FIG. 2*b* collapses in a manner similar to that of the pallet illustrated in FIG. 3*a*, as illustrated in FIG. 3*b*.

Figure 3A:
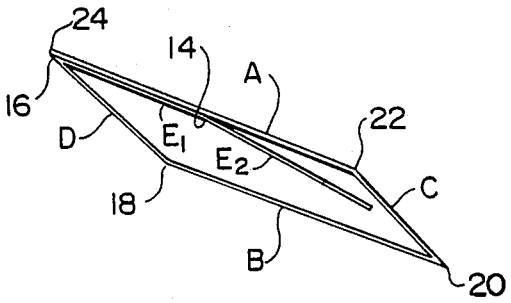
FIGS. 3*a* and 3*b* each illustrate a side view of the pallets of FIGS. 2*a* and 2*b* in a collapsed condition, respectively.
Figure 3B:
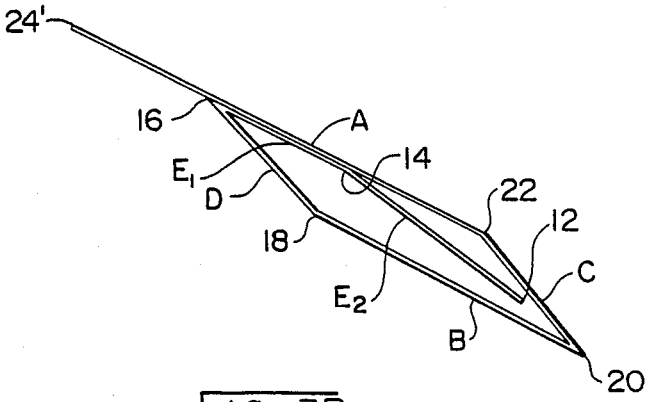

Other embodiments of pallet sections in accordance with the present invention are formed by adding additional support sections to the first support A of the second embodiment illustrated in FIG. 3*a*. In other words, the end 24 of the first support A is replaced with a fold line 24' and at least one additional section is added along the fold line 24'. For example, in a third embodiment illustrated in FIGS. 4–6, a sixth support F is defined between fold lines 24' and 26, and a seventh support G is defined between fold line 26 and the second end 28 of the sheet, so that the sixth support F is contiguous with the first support A and the seventh support G is contiguous with the sixth support F. In the erected configuration, the sixth support F is substantially perpendicular to the first and second supports A, B, and substantially parallel to the third and fourth supports C, D. In addition, in the erected condition, the seventh support G is substantially perpendicular to the third, fourth and sixth supports C, D, F, and substantially parallel to the first and second supports A, B.

Figure 4:
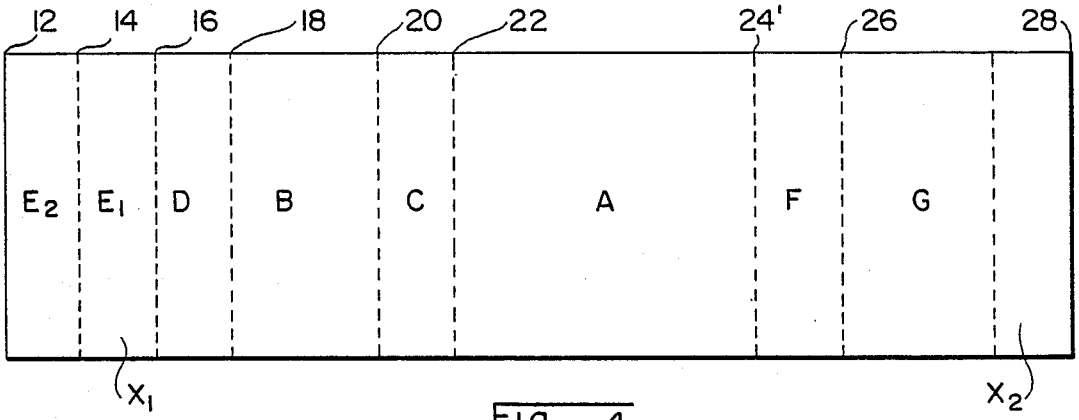
FIG. 4 illustrates a flat sheet of bendable material arranged to form a pallet section in accordance with a third embodiment of the present invention.
Figure 5:
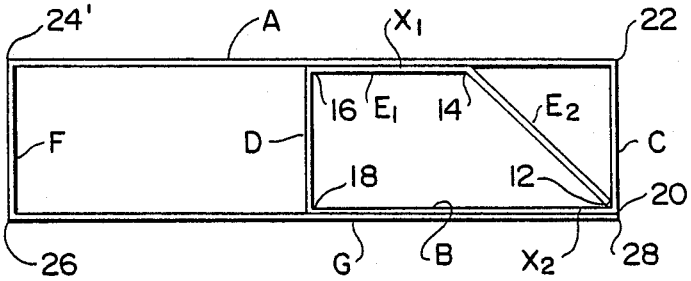
FIG. 5 illustrates a side view of the pallet section constructed from the sheet of FIG. 4.
Figure 6:
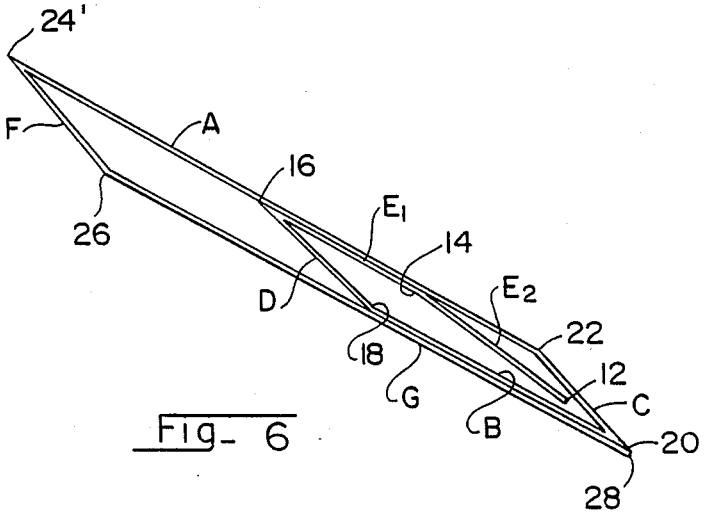
FIG. 6 illustrates the pallet of FIG. 5 in a collapsed condition.

In the third embodiment illustrated in FIGS. 4–6, an edge of the seventh support G is the second end 28 of the single sheet 10. Preferably, the second end 28 of the single sheet 10 is located adjacent the fold line 20 between the second and third supports B, C in the erected configuration, but this is unnecessary provided the seventh support G overlaps the second support B. In addition to the attachment portion X1 between the first portion E1 of the fifth support and the first support A, the third embodiment includes an attachment portion X2 for attaching the overlap between the seventh support G and the second support B.

The pallet of the third embodiment illustrated in FIG. 5 collapses in a manner similar to the first and second embodiments as illustrated in FIG. 6.

A fourth embodiment of the pallet section in accordance with the present invention is illustrated in FIGS. 7–9. The fourth embodiment is similar to the third embodiment except the length of the seventh support G is shortened to eliminate any overlap between the seventh support G and the third support C, and provide a fold line 28' from which two additional supports H, I are added to the seventh support G. As illustrated in FIG. 7, an eighth support H is contiguous to the seventh support G along fold line 28', while the ninth support I is contiguous with the eighth support H along the fold line 30. The ninth support I includes an edge which defines the second end 32 of the sheet 10.

In the erected configuration of the fourth embodiment, the eighth support H is substantially perpendicular to the first, second and seventh supports A, B, G, and substantially parallel to the third, fourth and sixth supports C, D, F. The eighth support H is located along side the fourth support D, and preferably fixed thereto by an attachment portion X3 located on either or both the fourth and/or eighth supports D, H.

The ninth support I is substantially parallel to the first, second and seventh supports A, B, G, and substantially perpendicular to the third, fourth, sixth and eight supports C, D, F, H. In addition to the attachment portion X1 between the first and fifth supports A, E1, the pallet section of the fourth embodiment includes an attachment portion X4 on the ninth support I for securing the ninth support to the first support A. Preferably, the second edge 32 of the ninth support I is adjacent to the fold line 24' between the first and sixth supports A, F.

The pallet section of the fourth embodiment collapses in a manner similar to the first, second and third embodiments, as illustrated in FIG. 9.

The supports of the pallet sections may include openings to facilitate handling of the pallets by a fork truck. For example, the fourth embodiment of the pallet section illustrated in FIG. 8 may include a series of aligned openings 50 in the third, fourth, fifth, sixth and eighth supports C, D, E2, F, H. Two series of aligned openings 50 may be provided for receiving each fork of the fork lift. Those skilled in the art recognize that other openings may be provided in a similar manner in all the embodiments described herein.

Figure 11A:
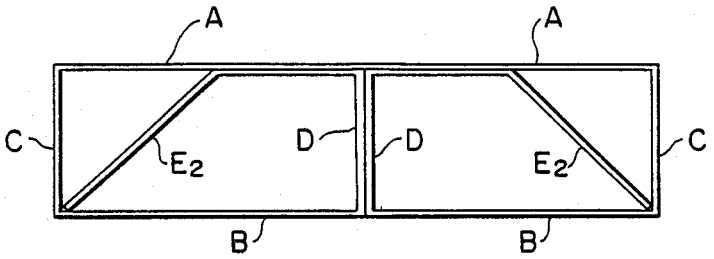
FIGS. 11A and 11B illustrate the erected and collapsed conditions of a two-part pallet structure formed by combining two pallet sections of FIG. 1A.
Figure 11B:
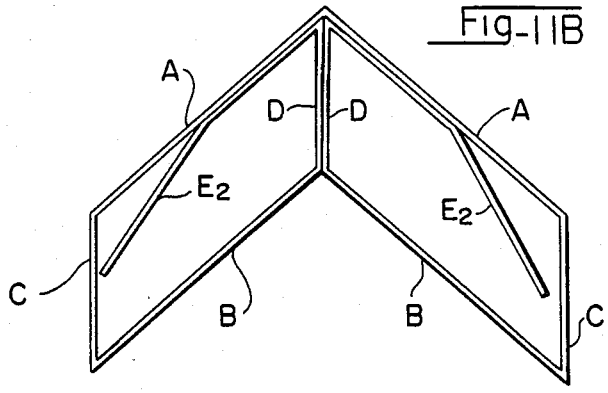
Figure 12A:
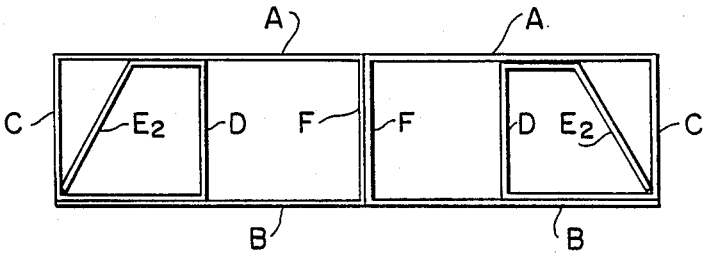
FIGS. 12A and 12B illustrate the erected and collapsed conditions of a two-part pallet structure formed by combining two pallet sections of FIG. 5.
Figure 12B:
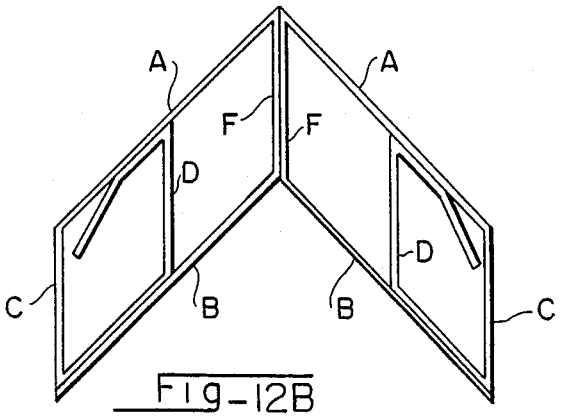

The pallet sections of the first through fourth embodiments may be combined to form a two part pallet structure. For example, the pallet section of FIG. 2*a* may be combined with another similar pallet section as illustrated in FIG. 11*a* to form a two-part symmetrical pallet structure with the fourth supports D abutting and the first support A being coplanar. The two pallet sections are fixed to one another by fixing together the fourth supports D of each pallet section, preferably by adhesive. The resulting pallet structure is collapsible into a V-shaped configuration as illustrated in FIG. 11*b*. In the collapsed configuration, the fourth supports D are located at the apex of the V-shaped configuration, the apex being the intersection area of the two pallet sections which define the legs of the V. In a similar manner, two pallet sections of the type illustrated in FIG. 5 can be combined to form a pallet as illustrated in FIG. 12*a*. With this construction, the sixth support of each pallet section are fixed together. Preferably, the first supports of each pallet section are coplanar to produce a symmetrical structure. The resulting symmetrical structure is collapsible into a substantially V-shaped configuration as illustrated in FIG. 12*b* with the sixth and first supports F, A forming the apex of the V-shaped configuration. An additional pallet can be constructed from the pallet section illustrated in FIG. 8 wherein two pallet sections are connected along the sixth support F as illustrated in FIG. 13*a*. The collapsed condition of the pallet illustrated in FIG. 13*a* is illustrated in FIG. 13*b*.

As discussed above in relation to FIG. 10, each pallet section of a symmetrical pallet structure may include a series of aligned openings to facilitate handling of the symmetrical pallet structure with a fork lift.

Further, additional vertical reinforcing supports or stiffeners may be provided on the pallet sections described herein to reinforce the pallet structure for greater strength, without interfering with the collapsing of the pallet. The stiffeners are separate from the single sheet of bendable material which forms the pallet section. For example, as illustrated in FIG. 13C, the pallet structure of FIG. 13B can be provided with a stiffener 55 at the junction of the two pallet sections (e.g., between the sixth supports F) and/or at the opposite unattached ends of the pallet sections (e.g., along the third supports C). The stiffeners 55 can be made of any material such as wood or cardboard and are fixed to the pallet sections, preferably by adhesive. The stiffeners 55 do not interfere with the collapsing of the pallet structure. In addition, the stiffener may be used with a single pallet section, or with a pallet structure of two or more pallet sections.

Figure 2B:
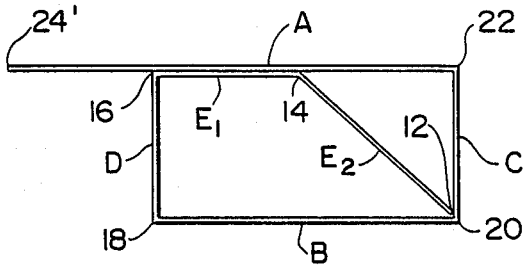
Figure 14A:
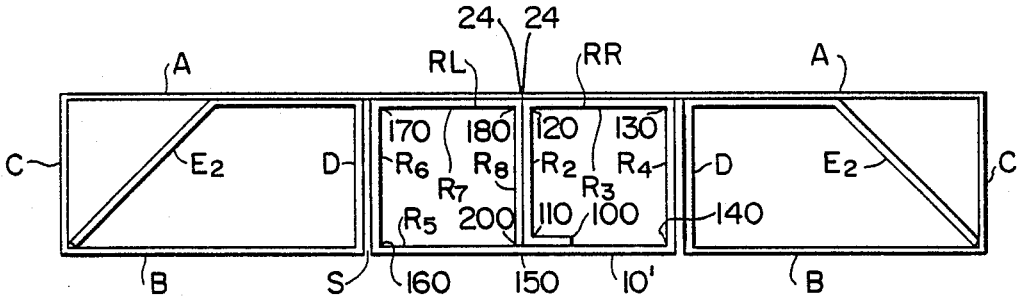
FIGS. 14A and 14B illustrate the erected and collapsed conditions of a three part pallet structure formed by inserting a pallet component between two pallet sections of FIG. 2B.
Figure 14B:
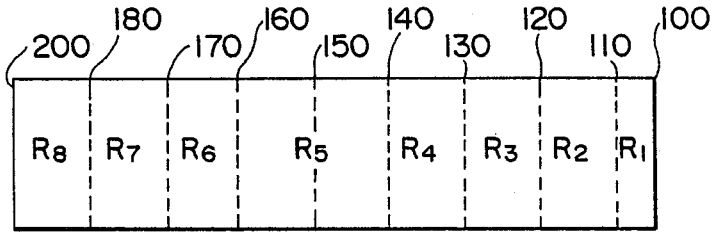

The present invention also contemplates the formation of a three piece collapsible pallet structure. In the three piece pallet structure, two of the pallet sections illustrated in FIG. 2*b* are combined such that the second ends 24 of each pallet section abut against each other as illustrated in FIG. 14*a*. With this construction, a space S is defined between the fourth supports D of each pallet section. A pallet component 10' can be located within the space between the fourth supports D of each pallet section. Preferably, the pallet component connects together the two pallet sections such that the pallet is collapsible into a V-shaped configuration illustrated in FIG. 14*b*. The pallet component 10' and the second edges 24 of each pallet section are located at the apex of the V-shaped configuration.

Figure 15:
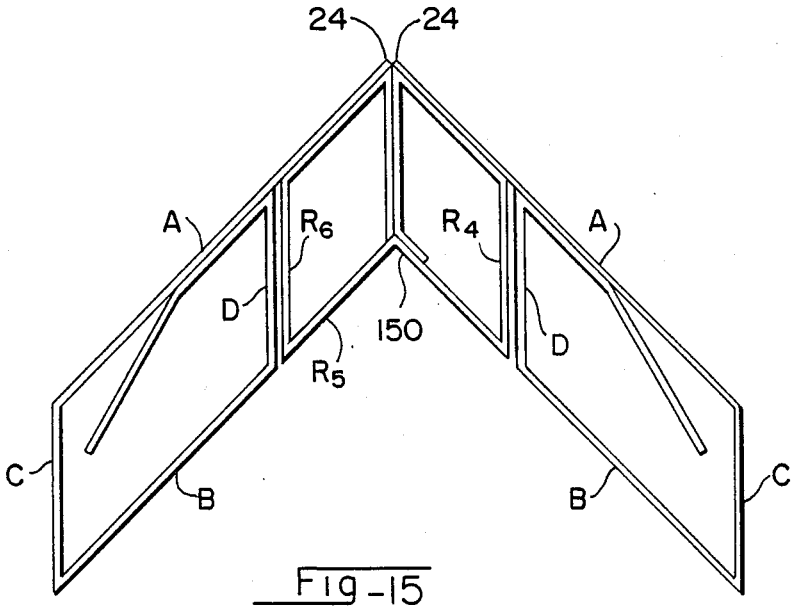
FIG. 15 illustrated a flat bendable sheet which is erected into the pallet component of FIGS. 14A and 14B.

In the preferred embodiment, the pallet component includes a single sheet of bendable material with a plurality of fold lines defining a plurality of panels between adjacent pairs of fold lines. The sheet is folded into an erected configuration to define two rectangular channels RR, RL sharing a common panel, preferably a common base. In particular, the single sheet of bendable material for the pallet component 10' is illustrated in FIG. 15*a* and includes two ends 100, 200 and fold lines 110, 120, 130, 140, 150, 160, 170 and 180. A panel is located between each pair of fold lines and a fold line and an adjacent end. A first one RR of the rectangular channels includes: a first panel $R_1$ between the end 100 and fold line 110; a second panel $R_2$ perpendicular to the first panel $R_1$ between the fold lines 110, 120; a third panel $R_3$ perpendicular to the second panel $R_2$ and parallel to the first panel $R_1$ between the fold lines 120, 130; a fourth panel $R_4$ parallel to the second panel between the fold lines 130, 140; and a fifth panel or common base $R_5$ parallel to the first and third panels $R_1$, $R_3$ between the fold lines 140, 160. The second channel RL includes a sixth panel $R_6$ between the fold lines 160, 170; a seventh panel $R_7$ between the fold lines 170, 180; and an eighth panel $R_8$ between the fold line 180 and end 200. In the preferred erected configuration, the first panel $R_1$ is fixed to the common base or fifth panel $R_5$ while the end 200 is unattached to the common base $R_5$. Alternatively, the end 200 may be a fold line which defines an additional panel like the first panel $R_1$, with both the first panel and additional panel being secured to the common base. Further, the common base or fifth panel $R_5$ incudes a central fold line 150 aligned with the first ends 24 of the pallet sections such that the first and second rectangular channels RR, RL of the pallet component can collapse within the space S between the fourth supports of each pallet section. Other configurations of pallet components are possible provided the pallet component collapses into a V-shaped configurations and the apex of the V is located between the second ends of the pallet sections.

In all of the foregoing embodiments, the dimensions of the supports can be varied to increase or decrease the size of the pallet. In all of the embodiments, however, the third, fourth, sixth and eighth supports should have equal dimensions so that the width of the pallet section is constant. Further, the term pallet has been used herein, but those skilled in the art recognize the teachings herein are applicable to other supports such as skids or spacers.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A collapsible pallet section comprising:

a single sheet of bendable material having first and second ends, and a plurality of flexible fold lines parallel to and between said ends for dividing said single sheet into a plurality of supports, each support being defined between a pair of fold lines and between a fold line and the first and second ends, said single sheet being folded along said plurality of fold lines to form a channel-like erected configuration of substantially rectangular cross-section which comprises, first and second substantially parallel supports in the erected configuration;

third and fourth substantially parallel supports substantially perpendicular to said first and second supports in the erected configuration, said third support being contiguous with the first and second supports and the fourth support being contiguous with the second support; and a fifth support extending between the third and fourth supports in the erected configuration, the fifth support being contiguous with the fourth support and having two portions, a first portion contiguous with the fourth support and substantially parallel and fixed to said first support, and a second remaining portion oblique with respect to the first and second supports, one edge of the second portion of the fifth support opposite from the first portion being the first end of the single sheet, the first end being unattached to any support and located in the erected configuration adjacent the fold line between the second and third supports, said erected configuration being collapsible to a substantially flat configuration in which the first end of said single sheet is located between the fold lines defining the third support.

2. The pallet section of claim 1, wherein an edge of said first support is the second end of the single sheet.

3. The pallet section of claim 2, wherein the second end of the single sheet is adjacent the first portion of the fifth support in the erected configuration.

4. The pallet of claim 1 further comprising a sixth support contiguous with the first support and a seventh support contiguous with the sixth support, said sixth support being substantially perpendicular to said first and second supports and substantially parallel to said third and fourth supports in the erected configuration, and said seventh support being substantially perpendicular to said third, fourth and sixth supports and substantially parallel to said first and second supports in the erected configuration.

5. The pallet section of claim 4, wherein an edge of the seventh support is the second edge of the single sheet and the seventh support includes an attachment portion fixed to the second support.

6. The pallet section of claim 5, wherein the second end of the single sheet is located adjacent the fold line between the second and third supports in the erected configuration.

7. The pallet section of claim 4 further comprising an eighth support continguous with the seventh support, and a ninth support contiguous with the eighth support, the eighth support being substantially perpendicular to the first, second and seventh supports and substantially parallel to the third, fourth and sixth supports in the erected configuration, the eigth support located along side the fourth support in the erected configuration, the ninth support being substantially parallel to the first, second and seventh supports, and substantially perpendicular to the third, fourth, sixth and eighth supports in the erected configuration.

8. The pallet section of claim 7, wherein the ninth support includes an attachment portion fixed to the first support, and an edge which is the second edge of the single sheet.

9. The pallet section of claim 8, wherein the second edge is located adjacent the fold line between the first and sixth supports.

10. The pallet section of claim 7, wherein the fourth and eighth supports are fixed to each other.

11. The pallet section of claim 1 further comprising at least one series of aligned openings in the third, fourth and fifth supports.

12. The pallet section of claim 4 further comprising at least one series of aligned openings in the third, fourth, fifth and sixth supports.

13. the pallet section of claim 7 further comprising at least one series of aligned openings in the third, fourth, fifth, sixth and eighth supports.

14. A collapsible pallet comprising at least two pallet sections, each pallet section comprising:

a single sheet of bendable material having first and second ends, and a plurality of flexible fold lines parallel to and between said ends for dividing said single sheet into a plurality of supports, each support being defined between a pair of fold lines and between a fold line and the first and second ends, said single sheet being folded along said plurality of fold lines to form a channel-like erected configuration of substantially rectangular cross-section which comprises first and second substantially parallel supports in the erected configuration;

third and fourth substantially parallel supports substantially perpendicular to said first and second supports in the erected configuration, said third support being contiguous with said first and second supports and said fourth support being contiguous with said second support; and a fifth support extending between the third and fourth supports in the erected configuration, the fifth support being contiguous with said fourth support and having two portions, a first portion contiguous with the fourth support and substantially parallel and fixed to said first support, and a second remaining portion oblique with respect to said first and second supports, one edge of said second portion of said fifth support opposite from said first portion being the first end of said single sheet and unattached to any support;

wherein the fourth supports of each pallet section are fixed to each other such that the pallet is collapsible into a V-shaped configuration, the fourth supports being located at the apex of the V-shaped configuration.

15. The pallet of claim 14, wherein an edge of the first support is the second end of the single sheet for each pallet section, the first supports for each pallet section being coplanar to form a symmetrical pallet, the second ends being located at the apex of the V-shaped configuration.

16. A collapsible pallet comprising at least two pallet sections, each pallet section comprising:

a single sheet of bendable material having first and second ends, and a plurality of flexible fold lines parallel to and between said ends for dividing said single sheet into a plurality of supports, each support being defined between a pair of fold lines and between a fold line and the first and second ends of the single sheet, the single sheet being folded along said plurality of fold lines to form a channel-like erected configuration of substantially rectangular cross-section which comprises:

first and second substantially parallel supports in the erected configuration;

third and fourth substantially parallel supports substantially perpendicular to said first and second supports in the erected configuration, said third support being contiguous with said first and second suports and said fourth support being contiguous with said second support; and a fifth support extending between the third and fourth supports in the erected configuration, the fifth support being contiguous with the fourth support and having two portions, a first portion contiguous with the fourth support and substantially parallel and fixed to said first support, and a second remaining portion oblique with respect to the first and second supports, one edge of the second portion of said fifth support opposite from said first portion being the first end of the single sheet;

wherein an edge of the first support is the second end of the single sheet, and the second ends of each single sheet for each pallet section abut against each other to define a space between the fourth supports of each pallet section.

17. The pallet of claim 16 further comprising a pallet component located in the space between the fourth supports of each pallet section.

18. The pallet of claim 17, wherein the pallet component connects together the at least two pallet sections such that the pallet is collapsible into a V-shaped configuration, the pallet component and the second edges being located at the apex of the V-shaped configuration.

19. The pallet of claim 17, wherein the pallet component connects together the at least two pallet sections, and the pallet component comprises a single sheet of bendable material having a plurality of fold lines and panels defined between adjacent pairs of fold lines, said sheet being folded into an erected configuration to define two rectangular channels sharing at least one common panel, the at least one common panel including a fold line aligned with the apex of the V-shaped configuration.

20. The pallet of claim 19, wherein the common panel is coplanar with the second supports of each pallet section.

21. A collapsible pallet comprising at least two pallet sections, each pallet section comprising:

a single sheet of bendable material having first and second ends, and a plurality of flexible fold lines parallel to and between said ends for dividing said single sheet into a plurality of supports, each support being defined between a pair of fold lines and between a fold line and the first and second ends, said single sheet being folded along said plurality of fold lines to form a channel-like erected configuration of rectangular cross-section which comprises first and second substantially parallel supports in the erected configuration;

third and fourth substantially parallel supports substantially perpendicular to said first and second supports in the erected configuration, said third support being contiguous with said first and second supports and said fourth support being contiguous with said second support;

a fifth support extending between the third and fourth supports in the erected configuration, the fifth support being contiguous with said fourth support and having two portions, a first portion contiguous with said fourth support and substantially parallel and fixed to said first support and a second remaining portion oblique with respect to said first and second supports, one edge of said second portion of said fifth supports opposite from said first portion being the first end of said single sheet;

a sixth support contiguous with said first support and a seventh support contiguous with said sixth support, said sixth support being substantially perpendicular to said first and second supports and substantially parallel to said third and fourth supports in the erected configuration, and said seventh support being substantially perpendicular to said first and second supports in the erected configuration;

wherein the sixth supports of each pallet section are fixed to each other such that the pallet is collapsible into a substantially V-shaped configuration, the sixth supports being the apex of the V-shaped configuration.

22. The pallet of claim 21, wherein the first supports of each pallet section are coplanar.

23. The pallet of claim 21, wherein each pallet section further includes an eighth support contiguous with the seventh support and a ninth support contiguous with the eigtht support, the eighth support being substantially perpendicular to the first, second and seventh supports and substantially parallel to the third, fourth and sixth supports in the erected configuration, the eighth support being located along side the fourth support in the erected configuration, the ninth support being substantially parallel to said first, second and seventh supports, and substantially perpendicular to said third, fourth, sixth and eighth supports in the erected configuration.

24. The pallet of claim 23, wherein the first supports of each pallet section are coplanar.

25. The pallet of claim 14, wherein each pallet section includes at least one series of aligned openings in the third, fourth and fifth supports, the series of aligned openings in one pallet section being aligned with the series of aligned openings in the other pallet section.

26. The pallet of claim 16, wherein each pallet section includes at least one series of aligned openings in the third, fourth and fifth supports, the series of aligned openings in one section being aligned with the series of aligned openings in the other section.

27. The pallet of claim 18, wherein each pallet includes at least one series of aligned openings in the third, fourth and fifth supports, and wherein the pallet component includes an opening aligned with the series of aligned openings in each of the pallet sections.

28. The pallet of claim 21, wherein each pallet section includes at least one series of aligned openings in the third, fourth, fifth and sixth supports, the series of aligned openings in one pallet section being aligned with the series of aligned openings in the other pallet section.

29. The pallet of claim 23, wherein each pallet section includes at least one series of aligned openings in the third, fourth, fifth, sixth and eighth supports, the series of aligned openings in one pallet section being aligned with the series of aligned openings in the other pallet section.

30. The pallet section of claim 1 further comprising a reinforcing support of a separate sheet from said single sheet, said reinforcing support being attached to at least one support of said pallet section.

31. The pallet of claim 14 wherein at least one of said pallet sections further comprises a reinforcing support of a separate sheet from said single sheet, said reinforcing support being attached to at least one support of said at least one pallet section.

32. The pallet of claim 16 wherein at least one of said pallet sections further comprises a reinforcing support of a separate sheet from said single sheet, said reinforcing support being attached to at least one support of said at least one pallet section.

33. The pallet of claim 21 wherein at least one of said pallet sections further comprises a reinforcing support of a separate sheet from said single sheet, said reinforcing support being attached to at least one support of said at least one pallet section.

34. The pallet of claim 33 wherein the reinforcing support is located between the sixth supports of the pallet sections.

35. The pallet of claim 33 wherein the reinforcing support is located against the third support of at least one pallet section.

36. The pallet of claim 15 wherein the second ends of each pallet section are connected together and define a fold line between the first supports of each pallet section.

* * * * *